US009149856B2

(12) United States Patent
Hosoi

(10) Patent No.: US 9,149,856 B2
(45) Date of Patent: Oct. 6, 2015

(54) SCREW-TOP BOTTLE-CAN AND METHOD FOR PRODUCING THE SAME

(75) Inventor: Masahiro Hosoi, Sunto-gun (JP)

(73) Assignee: Universal Can Corporation, Tokyo (JP)

( * ) Notice: Subject to any disclaimer, the term of this patent is extended or adjusted under 35 U.S.C. 154(b) by 0 days.

(21) Appl. No.: 14/007,132

(22) PCT Filed: Mar. 27, 2012

(86) PCT No.: PCT/JP2012/057907

§ 371 (c)(1), (2), (4) Date: Sep. 24, 2013

(87) PCT Pub. No.: WO2012/133391

PCT Pub. Date: Oct. 4, 2012

(65) Prior Publication Data

US 2014/0008320 A1 Jan. 9, 2014

(30) Foreign Application Priority Data

Mar. 28, 2011 (JP) ..... 2011-069474

(51) Int. Cl.

*B21D 51/26* (2006.01)
*B21H 3/02* (2006.01)
*B65D 1/02* (2006.01)

(52) U.S. Cl.

CPC ..... *B21D 51/26* (2013.01); *B21D 51/2615* (2013.01); *B21H 3/02* (2013.01); *B65D 1/0238* (2013.01); *B65D 1/0246* (2013.01); *Y10T 29/49* (2015.01)

(58) Field of Classification Search

CPC ..... B65D 1/02; B65D 1/023; B65D 1/0246; B21D 3/14; B21D 22/28; B21D 41/04; B21D 51/26; B21D 51/2638

See application file for complete search history.

(56) References Cited

U.S. PATENT DOCUMENTS 5,704,240 A 1/1998 Jordan
5,822,843 A * 10/1998 Diekhoff et al. ..... 29/512

(Continued)

FOREIGN PATENT DOCUMENTS

JP 05-229545 A 9/1993
JP 2000-191006 A * 7/2000 ..... B21D 51/16

(Continued)

OTHER PUBLICATIONS

International Seach Report dated Jun. 19, 2012, issued for PCT/JP2012/057907.

*Primary Examiner* — Edward Tolan
(74) *Attorney, Agent, or Firm* — Locke Lord LLP; James E. Armstrong, IV; Brian S. Matross

(57) ABSTRACT

A method for producing a screw-top bottle-can and a screw-top bottle-can are provided so that a screw-thread can be formed without damaging an inner coating and a resealing operation can be improved. A shoulder part is formed by reducing a diameter of an opening part of a closed-end cylindrical body, a cylindrical part having an intermediate diameter between a major thread diameter and a minor thread diameter and a tapered part which is tapered from an upper end of the cylindrical part toward an opening-end part are formed above the shoulder part, and forming a screw-thread from the tapered part to the cylindrical part so as to form a starting part of the screw-thread at a middle part of the tapered part.

9 Claims, 9 Drawing Sheets

(56) References Cited

U.S. PATENT DOCUMENTS

| | | | | |
|---|---|---|---|---|
| 7,798,357 | B2 * | 9/2010 | Hanafusa et al. | 220/288 |
| 8,091,402 | B2 * | 1/2012 | Hanafusa et al. | 72/379.4 |
| 2005/0067365 | A1 * | 3/2005 | Hanafusa et al. | 215/43 |
| 2009/0211329 | A1 | 8/2009 | Hanafusa et al. | |
| 2012/0024813 | A1 * | 2/2012 | Nakagawa et al. | 215/40 |

FOREIGN PATENT DOCUMENTS

| | | | | | |
|---|---|---|---|---|---|
| JP | 2002-066674 | A | | 3/2002 | |
| JP | 2003-154426 | A | * | 5/2003 | B21D 51/26 |
| JP | 2004-148403 | | * | 5/2004 | B21D 51/38 |
| JP | 2004-160468 | A | | 6/2004 | |
| JP | 2006-176183 | A | | 7/2006 | |

* cited by examiner (a)

(b)

(a)

(b)

SCREW-TOP BOTTLE-CAN AND METHOD FOR PRODUCING THE SAME

BACKGROUND OF THE INVENTION

1. Field of the Invention

The present invention relates to a method for producing a screw-top bottle-can having a screw-thread on which a cap is screwed, and a screw-top bottle-can.

Priority is claimed on Japanese Patent Application No. 2011-069474, filed Mar. 28, 2011, the content of which is incorporated herein by reference.

2. Background Art

As a container in which contents such as a beverage or the like is filled, a can (a bottle-can) which is made by aluminum alloy, with a mouth part having a male thread on which a cap is screwed, and has a bottle-shape, is known.

As disclosed by Patent Document 1 or Patent Document 2, the bottle-can is produced by forming a sheet metal of aluminum-alloy into a closed-end cylindrical body in which a bottom plate part and a cylindrical-side-surface part are united by drawing and ironing (DI process), making a shoulder part by reducing a diameter of an opening part and making an expanded cylindrical part at an upper part than the shoulder part for forming a thread, then performing a thread-forming process on the cylindrical part, performing a curl-forming process on an opening-end part, and the like.

In bottle-cans of this kind, inner and outer surfaces of the closed-end cylindrical body are coated before the process of reducing the diameter of the opening part. For processing the opening part particularly without damaging the coating of the inner surface, there is a method described in Patent Document 3.

Patent Document 3 describes an intermediate formed product before a thread-forming process in which a cylindrical part having an outer diameter of a middle of a major diameter and a minor diameter of a screw-thread is formed at a second-step section from an opening end by forming the mouth part so as to have at least two steps from shoulder part by drawing, and then the thread-forming process is performed with clamping the cylindrical part between an inner die and an outer die.

PRIOR ART DOCUMENTS

Patent Documents

Patent Document 1: U.S. Pat. No. 5,704,240

Patent Document 2: Japanese Unexamined Patent Application, First Publication No. H05-229545

Patent Document 3: Japanese Unexamined Patent Application, First Publication No. 2002-66674

SUMMARY OF THE INVENTION

Problem to be Solved by the Invention

According to the method described in Patent Document 3, since the outer diameter of the cylindrical part before the thread-forming process is formed at the intermediate diameter between the major diameter and the minor diameter of the screw-thread, it can be expected to reduce plastic deformation by the thread-forming process and the damages of coatings.

The bottle-can of this kind can be resealed by screwing the cap on after opened. Furthermore, the bottle-can is required to be resealed with easy operation.

The present invention is achieved in consideration of the above circumstances, and has an object to provide a screw-top bottle-can and a method for producing a screw-top bottle-can in which a thread can be formed without damaging an inner coating and operability of resealing is improved.

Means for Solving Problem

By earnest research of resealing operation after uncapping, the present inventors considered that the resealing operation can be facilitated by smoothly engaging a lowest end of a ridge portion of a screw-thread at an inner surface side of a cap with a groove portion between a first ridge and a second ridge of a screw-thread of a bottle-can. On the other hand, if the method of Patent Document 3 is utilized, the outer diameter of the cylindrical part before the thread-forming process is formed to the intermediate diameter between the major diameter and the minor diameter of the screw-thread, and the thread-forming process is performed on the part of the intermediate diameter, so that an unprocessed part is remained to have a larger diameter than the minor diameter of the thread at a tapered part (especially at a back of a starting part of the thread) from a curl portion to a first round of a first ridge of the screw-thread, and the unprocessed part is found to generate the resistance of resealing.

Consequently, in order to enable operation of easy resealing, the inventors decided that it is important to form a thread so as not to leave a larger part than the minor diameter of the thread at the tapered part from the curl portion to the first round of the first ridge of the screw-thread, and adopted a means for solving the problem.

The present invention is a method for producing a screw-top bottle-can, in which: forming a shoulder part by reducing a diameter of an opening part of a cylindrical body; forming a cylindrical part having an intermediate diameter between a major diameter and a minor diameter of a screw-thread and a tapered part which is tapered from an upper end of the cylindrical part toward an opening-end part above the shoulder part; and forming the screw-thread from the tapered part to the cylindrical part so as to form a starting part of the screw-thread at a middle of the tapered part.

In the method for producing bottle-can according to the present invention, it is preferable that in a vertical section along a can-axis direction at the starting part of the screw-thread, the screw-thread be formed so that a bend part between the tapered part and the cylindrical part be arranged in a region between a second ridge of the screw-thread and a groove portion above the second ridge.

It is preferable that the tapered part be inclined at 10° to 30° with respect to the can-axis direction.

According to the method for producing of the present invention, the cylindrical part is formed to have the intermediate diameter between the major diameter and the minor diameter of the screw-thread, and the starting part of the screw-thread is formed to be arranged at the middle of the tapered part by forming the screw-thread. Therefore, the unprocessed part is restricted from being expanded larger than the minor diameter of the screw-thread even though the unprocessed tapered portion is left at a back of the starting part of the screw-thread. Accordingly, when resealing the cap, a resistance can be suppressed small while the lowest end of the ridge portion at the inner side of the cap is guided to the groove portion between the starting part of the screw-thread and the next ridge portion of the bottle-can.

The plastic deformation amount by the process is small because the cylindrical part before forming the screw-thread is formed to have the intermediate diameter between the major diameter and the minor diameter of the screw-ridge. In this case, in one round from the starting part of the screw-thread in which the tapered part is deformed, a portion having a smaller outer diameter than the intermediate diameter between the major diameter and the minor diameter of the screw-thread is deformed. However, it is a first ridge of thread-forming so that the opening-end part above the first ridge is not formed. Therefore, a flux material is hardly restricted in the process.

Incomplete-thread parts are formed in regions in which height of the ridge portion is not enough for a prescribed height of the ridge portion. The start part of the screw-thread is a portion having about a half height of the ridge portion. The height of the ridge portion is an average of maximum value between the ridge portion and the groove portion adjacent to the ridge portion along a radial direction. The major diameter means an external diameter of the ridge portion. The minor diameter means an external diameter of the groove portion.

A bottle-can of the present invention is a bottle-can which is made by the method for producing of the present invention.

It is more preferable that a bottle-can of the present invention be formed so that a tapered part formed from below a curl portion which is formed at an end of an opening part to a first round of a first ridge of a screw-thread have a maximum outer diameter which is equal to or smaller than a minor diameter of a groove portion of the screw-thread which is adjacent to the first ridge.

Effects of the Invention

According to the present invention, the tapered part at the back of the starting part of the screw-thread is prevented from being expanded larger than the minor diameter of the screw-thread. Accordingly, when resealing the cap, the resistance can be suppressed small while the lowest end of the ridge portion at the inner side of the cap is guided to the groove portion between the starting part of the screw-thread and the next ridge portion of the bottle-can, so that it is enabled to reseal with ease. Moreover, the plastic deformation amount by forming the screw-thread is small, and the flux of material in forming is hardly restricted even at the first ridge of the screw-thread. Therefore, the damage on the inner coating can be prevented.

DETAILED DESCRIPTION OF THE INVENTION

Figure 1:
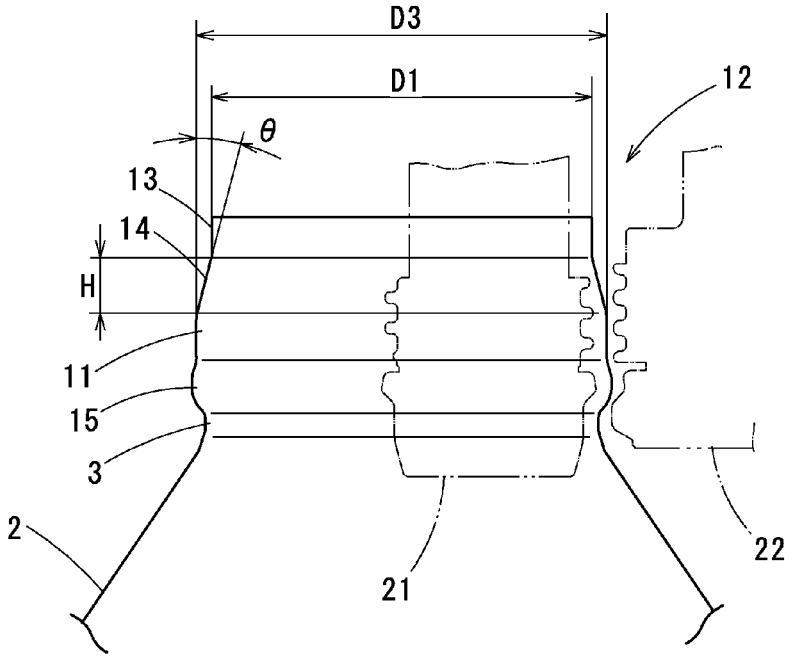
[FIG. 1] It is a front view showing a vicinity of a cylindrical part of an intermediate formed product while producing according to an embodiment of the present invention.

Below, an embodiment of the present invention will be explained.

A bottle-can 1 is formed from a sheet metal of aluminum or aluminum-alloy. On a closed-end cylindrical can-body part (not illustrated): a shoulder part 2 is formed to be tapered upward; a neck part 3 having smaller diameter is formed at an upper end of the shoulder part 2; a mouth part 4 is formed at an upper end of the neck part 3; a screw-thread 5 is formed at an outer periphery of the mouth part 4; a jaw part 6 in which a skirt-end part of a cap is fixed is formed below the screw-thread 5; and a curl portion 7 is formed above the screw-thread 5.

When producing the bottle-can 1, the shoulder part 2 is formed by reducing a diameter of opening part of a closed-end cylindrical body which is formed by drawing and ironing (i.e., DI forming) a sheet metal of aluminum-alloy or the like; and then, a cylindrical part 11 which is expanded for forming screw-thread is formed above the shoulder part 2.

Figure 2:
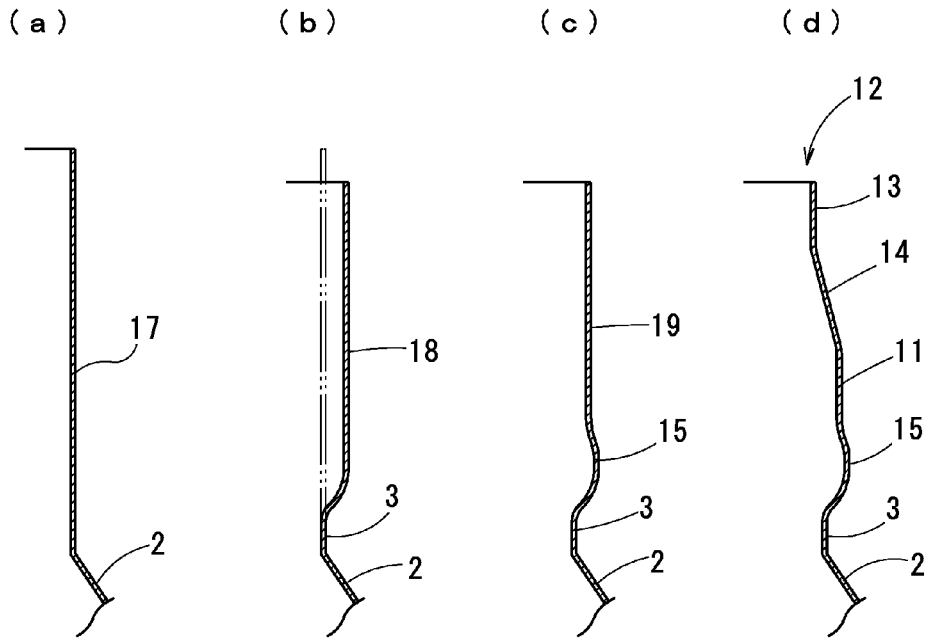
[FIG. 2] It is a sectional view showing a principal part in a forming process of the intermediate formed product of a bottle-can of FIG. 1 in order from (a) to (d).

It will be specifically explained by FIG. 2. As shown by the part (a) of FIG. 2, the shoulder part 2 is formed by reducing the diameter of the opening part of the closed-end cylindrical body, and a cylindrical reduced-diameter portion 17 is formed above the shoulder part 2. This process for reducing diameter is a so-called die-necking process, the shoulder part 2 and the reduced-diameter portion 17 shown in the part (a) of FIG. 2 are formed by reducing the diameter of the opening part gradually by using forming tools having various diameters sequentially.

Figure 3:
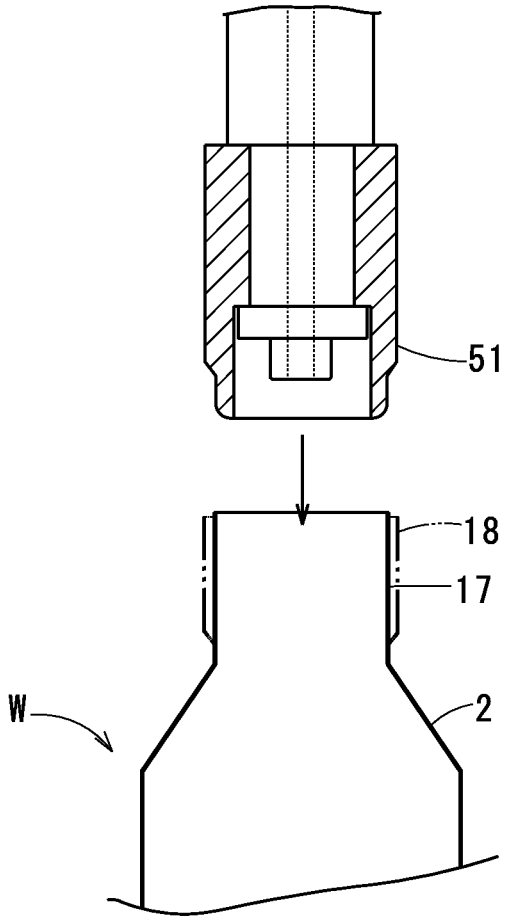
[FIG. 3] It is a sectional view showing a punch which expands a diameter of an opening part.

Subsequently, as shown in the part b) of FIG. 2, the reduced-diameter portion 17 is expanded upward from a position slightly above the upper end of the shoulder part 2 except a lower end part of the reduced-diameter port on 17, so that a large-diameter portion 18 is formed. An apparatus for forming the large-diameter portion 18 is provided with an expanding punch 51 which is inserted along a can-axis direction to the opening part (the reduced-diameter portion 17) of the closed-end cylindrical body W which is held by a work-holding part (not illustrated) as shown in FIG. 3. The large-diameter portion 18 is formed by inserting the expanding punch 51 into the reduced-diameter portion 17 of the closed-end cylindrical body W. After the process of the large-diameter portion 18, a portion at a lower end part of the reduced-diameter portion 17 in which the diameter thereof is not expanded becomes the neck part 3.

Figure 4:
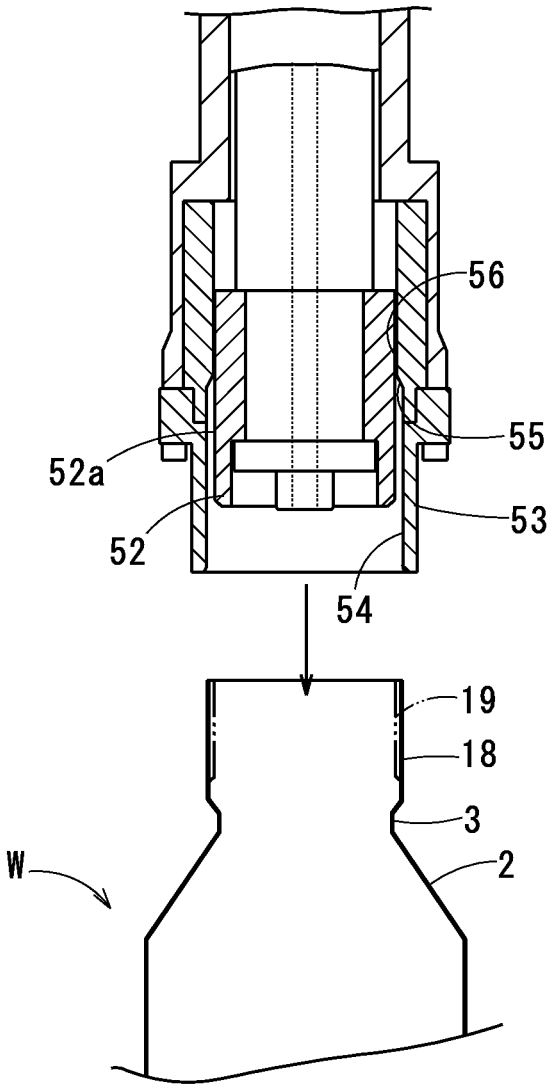
[FIG. 4] It is a sectional view showing a forming tool for die-necking which reduces the diameter of the opening part.

Next, as shown in the part (c) of FIG. 2, except for the lower end part of the large-diameter portion 18, a small-diameter portion 19 is formed by reducing a diameter of an upper portion than the lower end part again. This process is the so-called die-necking process, forming tool thereof is provided with an inner die 52 which is inserted along the can-axis direction into the opening part (the large-diameter portion 18)

of the closed-end cylindrical body W which is held by the work-holding part (not illustrated), and an outer die 53 which is disposed outside of the inner die 52, as shown in FIG. 4. An outer diameter of the inner die 52 is smaller than an inner diameter of the opening part (the large-diameter portion 18) of the closed-end cylindrical body W before processing, and is formed at an outer diameter after reducing diameter. An inner peripheral surface of the outer die 53 is formed in order of: a guide surface 54 having an inner diameter which accepts the opening part (the large-diameter portion 18) of the closed-end cylindrical body W before processing; a tapered surface 55 for drawing in which the diameter of the opening part is reduced; and a small-diameter surface 56 forming a gap between the outer peripheral surface of the inner die 52 in which the reduced opening part is inserted, from a tip of the outer die 53. The opening part (the large-diameter portion 18) of the closed-end cylindrical body W is press-inserted along the guide surface 54 of the outer die 53, so that the diameter thereof is reduced after the tapered surface 55; and the opening part is inserted between an outer peripheral surface 52*a* of the inner die 52 and the small-diameter surface 56 of the outer die 53, so that it is formed as the small-diameter portion 19. Also for the above-mentioned process shown in the part (a) of FIG. 2, a plurality of inner dies and outer dies having the similar structure as shown in FIG. 4, though diameters thereof are not the same, are used.

After the process of the small-diameter portion 19, a portion which is not processed below the small-diameter portion 19 becomes an expanded-diameter portion 15. The small-diameter portion 19 is formed to have a larger outer diameter than that of the neck part 3, and to have an outer diameter which is intermediate between a minor diameter and a major diameter of the screw-thread 5 stated below.

Next, as shown in the part (d) of FIG. 2, an open-end part 13 in which a diameter is reduced and a tapered part 14 which is connected to the opening-end part 13 are formed by gradually reducing the diameter of an upper half of the small-diameter portion 19 upward. This process is also performed by using the similar forming tool for die-necking process as FIG. 4. After the process of the opening-end part 13 and the tapered part 14, a portion which is not processed below them becomes the cylindrical part 11. Thus the intermediate formed product 12 is formed. The cylindrical part 11 is formed to have a thickness of 0.25 to 0.4 mm.

In the intermediate formed product 12, after forming the screw-thread 5 on the cylindrical part 11, the diameter of the opening-end part 13 is further reduced and the curl portion 7 is formed at a portion in which the diameter thereof is reduced, so that the bottle-can 1 is produced.

In this producing process, as shown also in FIG. 1, in the intermediate formed product 12: the opening-end part 13 is formed straightly of a necessary length from the upper end for forming the curl portion 7; the tapered part 14 is formed so as to be gradually expanded downward from the lower end of the opening-end part 13; and the cylindrical part 11 is formed at the lower end of the tapered part 14. The cylindrical part 11 is formed practically into a straight cylindrical shape except the lower end part. The lower end part of the cylindrical part 11 is the expanded-diameter portion 15 having the larger outer diameter than that of the upper part thereof. At the lower end of the expanded-diameter portion 15, the neck part 3 in which the diameter is reduced and the shoulder part 2 in which the diameter is expanded from the lower end of the neck part 3 are connected.

In this case, an outer diameter D1 of the opening-end part 13 is smaller than a minor thread diameter D2 which should be formed: and an outer diameter D3 of the cylindrical part 11 is set to an intermediate diameter between a major thread diameter D4 and the minor thread diameter D2 except the expanded-diameter portion 15 at the lower end part of the cylindrical part 11. For example, in a case in which the major thread diameter D4 is 37 mm, the minor thread diameter D2 is 36.3 mm, and a distance between a first ridge and a second ridge of the screw-thread is 2.5 mm to 4.5 mm; the outer diameter D3 is set to 36.5 mm to 36.8 mm except the expanded-diameter portion 15 of the cylindrical part 11. In the tapered part 14 which connect the cylindrical part 11 and the opening-end part 13, an inclined angle θ is set to 10° to 30° with respect to the can-axis direction and a length H along the can-axis direction is set to 2.0 mm to 6.0 mm.

Figure 5:
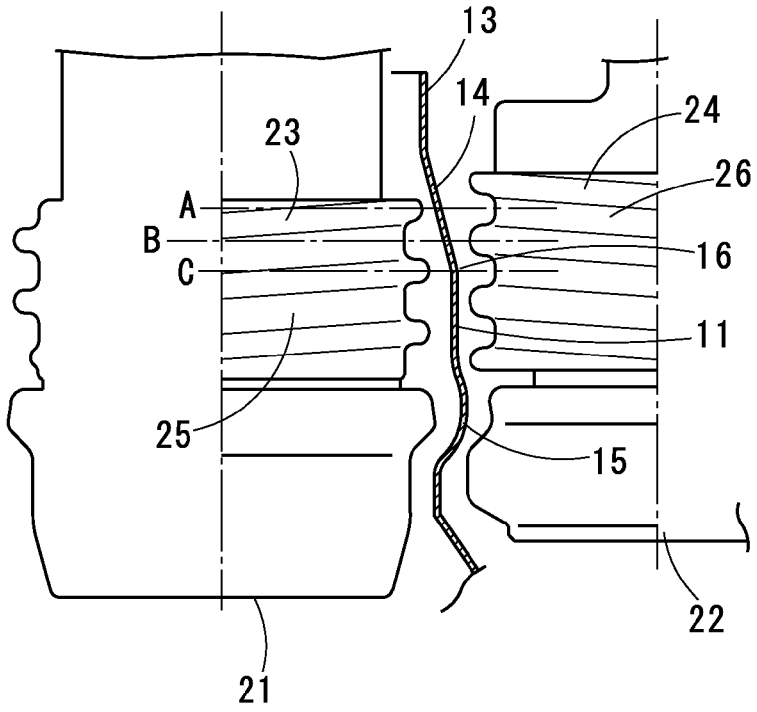
[FIG. 5] It shows a state in which a thread-forming process is operated on the intermediate formed product of the bottle-can of FIG. 1: the part (a) is a vertical sectional view at a position corresponding to a starting part of screw-thread showing a state in which an inner die and an outer die are disposed inside and outside the bottle-can; and the part (b) is a vertical sectional view at the same position as in the part (a) showing a state of the thread-forming process by clamping the bottle-can between the inner die and the outer die.
Figure 5:
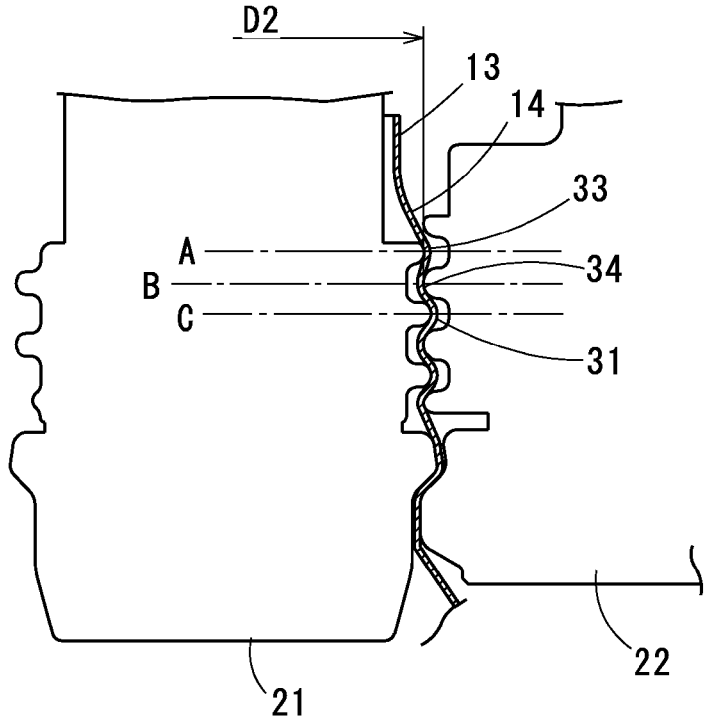

Next, an apparatus for forming the screw-thread 5 on the intermediate formed product 12 will be explained. The thread-forming apparatus has an inner die 21 which is in contact with an inner peripheral surface of the cylindrical part 11 of the intermediate formed product 12 and an outer die 22 which is in contact with an outer peripheral surface of the cylindrical part 11 of the intermediate formed product 12. As shown in FIG. 1 and FIG. 5, for forming the screw-thread 5, a protruded portion 23 and a recess portion 25 for thread-forming on an outer peripheral surface of the inner die 21 and a protruded portion 24 and a recess portion 26 for thread-forming on an outer peripheral surface of the outer die 22 are formed helically so as to have shapes corresponding with each other. The inner die 21 and the outer die 22 are moved along a radial direction, so that the cylindrical part 11 of the intermediate formed product 12 is clamped between the protruded portions and the recess portions of each other. The screw-thread 5 is formed on the cylindrical part 11 by rotating the inner die 21 and the outer die 22 around an axis of the intermediate formed product 12. At the same time, the jaw part 6 positioned below the screw-thread 5 is also formed.

The thread-forming by the inner die 21 and the outer die 22 will be described in detail with referring to FIG. 5 and FIG. 6.

Figure 7:
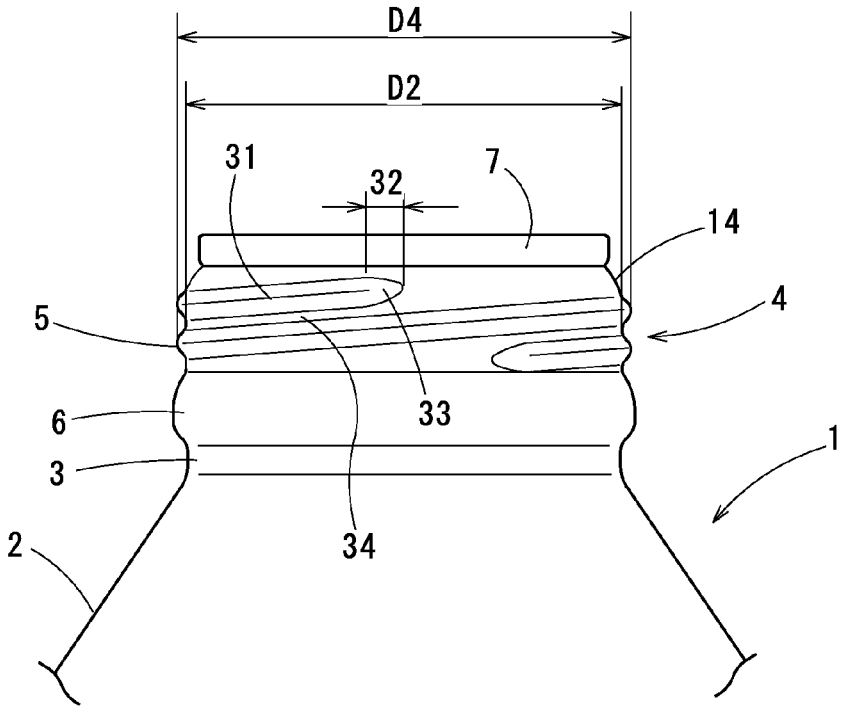
[FIG. 7] It is a front view showing a vicinity of a mouth part of the bottle-can of the embodiment.

The shape of the screw-thread 5 will be explained in advance. As shown in FIG. 7, in the screw-thread 5, a starting part 33 of screw-thread is a portion having about a half height of the ridge portion 31 of the incomplete-thread part 32. The height of the ridge portion 31 is an average of maximum value between the ridge portion 31 and a groove portion 34 adjacent to the ridge portion 31 along the radial direction. The major thread diameter means an external diameter of the ridge portion 31. The minor thread diameter means an external diameter of the groove portion 34.

The thread-forming process is not limited to start at the starting part 33 of screw-thread; but can be started at any point.

FIG. 5 shows a vertical section at a part corresponding to the starting part 33 of screw-thread after the thread-forming process: the part (a) shows a state in which the inner die 21 is inserted in the cylindrical part 11 of the intermediate formed product 12 and the outer die 22 is arranged at radially the outside of the cylindrical part 11, so that the dies are confronted with each other; and the part (b) shows a state in which the inner die 21 and the outer die 22 are approached so as to clamp the cylindrical part 11 from the middle of the tapered part 14. For convenience, the part (a) of FIG. 5 shows a front view of halves of the inner die and the outer die, and remaining halves are shown only by outlines; on the contrary, the part (b) of FIG. 5 shows the inner die and the outer die only by outlines. In FIG. 6 which is mentioned below, the parts (a) and (b) show only external forms of the inner die and the outer die.

In this section, the position of the dot-and-dash line "A" shows a first ridge of the screw-thread (that is the starting part 33 of screw-thread at the sectional position of FIG. 5 and becomes the incomplete-thread part 32), the position of the dot-and-dash line "B" shows a groove portion below the first ridge, and the position of the dot-and-dash line "C" shows a second ridge of the screw-thread.

At the position of the starting part 33 of screw-thread, as shown in the part (a) of FIG. 5, a bend part 16 between the cylindrical part 11 and the tapered part 14 is arranged in a region between the second ridge C and the groove portion B above the second ridge C. In the illustrated sample, the bend part 16 is arranged substantially at a crest of the second ridge C. The bend part 16 is preferable to have a radius of curvature of 0.6 mm to 10 mm. If the radius of curvature is smaller than 0.6 mm, a load for reducing the diameter shown in the part (d) of FIG. 2 is large, so that the mouth part 4 may be buckled, and further, a load for forming the thread is large. If the radius of curvature is larger than 10 mm, the tapered part 14 is long, so that a protruding size by the inner die 21 is large in the thread-forming, and the inner coating may be damaged.

By the thread-forming process in which the dies 21 and 22 approach each other from the state shown in the part (a) of FIG. 5 and clamp the cylindrical part 11, as shown in the part (b) of FIG. 5, a maximum outer diameter of the tapered part 14 which remains above a position A of the first ridge is equal to or smaller than the minor thread diameter D2.

Figure 6:
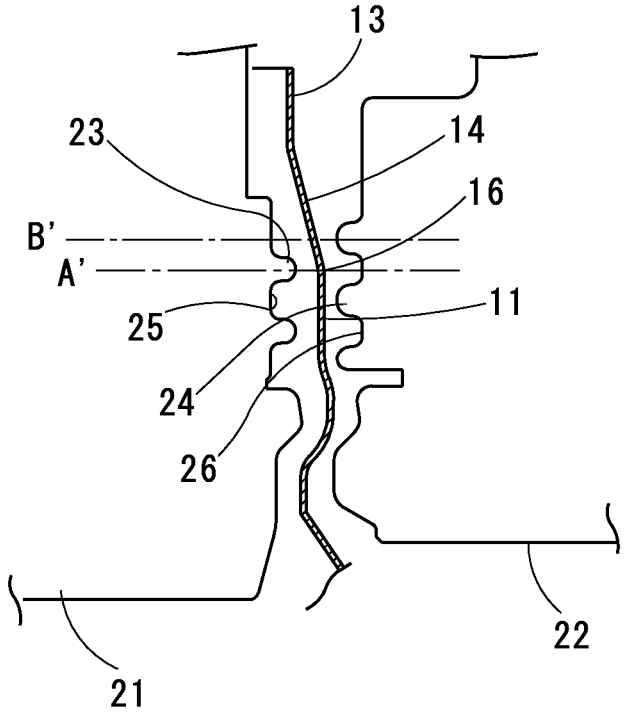
[FIG. 6] It is a vertical sectional view at a position corresponding to a back part than the starting part of screw-thread of FIG. 5 but similar to FIG. 5.
Figure 6:
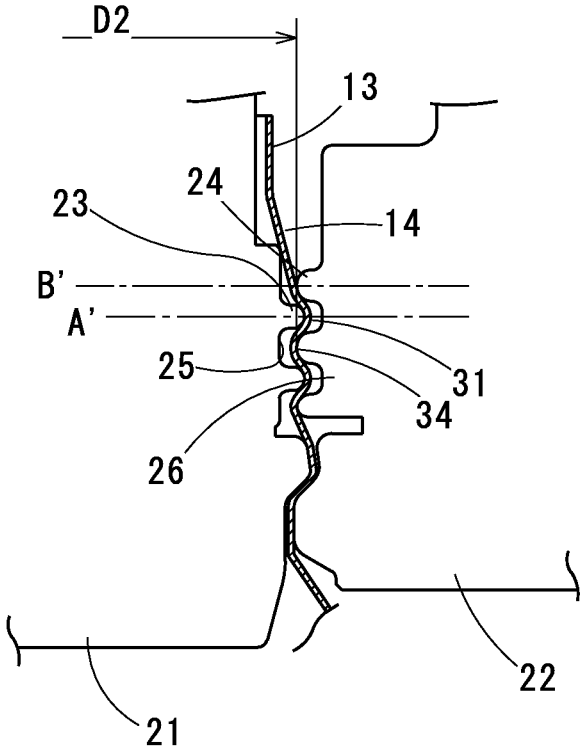

FIG. 6 shows a vertical section at a back position than the starting part 33 of screw-thread. In other words, it is the vertical section at a position before the second ridge, and also at a front of the first round of the first ridge.

In FIG. 6, similarly to FIG. 5, the part (a) shows a state in which the inner die 21 is inserted in the cylindrical part 11 of the intermediate formed product 12 and the outer die 22 is arranged at radially the outside of the cylindrical part 11, so that the dies are confronted with each other; and the part (b) shows a state in which the inner die 21 and the outer die 22 are approached so as to clamp the cylindrical part 11 from the middle of the tapered part 14. In the section of FIG. 6, the position of the dot-and-dash line of A' shows the first ridge of screw-thread (the thread ridge before the second ridge and the front of the first round); and the position of the dot-and-dash line B' shows the position before the groove portion above the position A'.

Also at the back position than the starting part 33 of screw-thread, by forming the screw-thread from the middle position of the tapered part 14 of the cylindrical part 11, as shown in the part (b) of FIG. 6, a maximum diameter of the tapered part 14 above the first ridge position A' (the position after the first round) is equal to or smaller than the minor thread diameter D2.

After the thread-forming process as above, the opening-end part 13 is further reduced in the diameter, and the curl portion 7 is formed by a curling process on the reduced opening-end part 13; so that the bottle-can 1 is produced.

A cap 41 on the bottle-can 1 has a circular top-plate part 42 and a cylindrical skirt part 43. By putting the cap 41 on the mouth part 4 of the bottle-can 1 and forming the skirt part 43 of the cap 41 so as to mold the screw-thread 5 of the mouth part 4 by a capping roll: the cap 41 is fixed as to be screwed on the mouth part 4; and a thread ridge 44 is formed on the skirt part 43. Furthermore, a lower-end part 45 of the skirt part 43 is wound up on the jaw part 6, so that the cap 41 and the bottle-can 1 are fixed so as to be screwed with each other as shown in the left half of FIG. 8. Since the cap 41 is thus fixed as to be screwed on the screw-thread 5 of the mouth part 4, an inner diameter of the thread ridge 44 of the cap 41 is fitted to the minor thread diameter D2 of the mouth part 4. With respect to the cap, the parts are described by the same reference symbols before and after the thread-forming process.

Next, a case in which the cap 41 is resealed after once opened will be explained.

Figure 8:
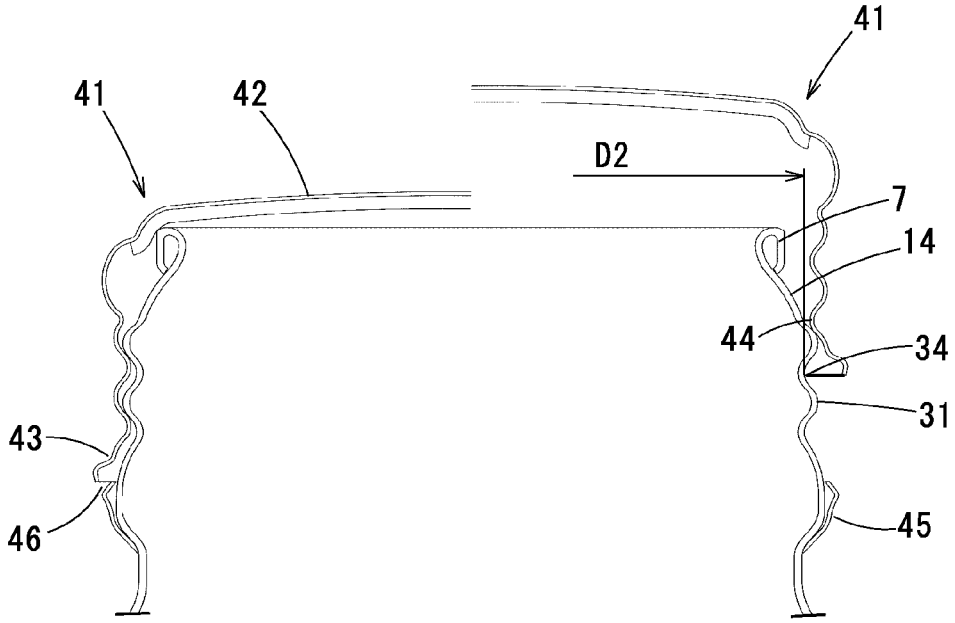
[FIG. 8] It is a sectional view showing a relationship between a cap and the bottle-can of the embodiment: a left half shows a state in which the cap is screwed on the bottle-can; and a right half shows a state before screwing the cap on the bottle-can.

When turning the cap 41 so as to be loosened from a screwing state shown in the left half of FIG. 8, the lower-end part 45 and the above part are divided at a slit 46 which is formed at the skirt part 43, so that the lower-end parts is remained into a strip on the jaw part 6, then the above part can be removed from the mouth part 4.

Next, when the removed cap 41 is put on the mouth part 4 for resealing, as shown in the right half of FIG. 8, the lowest end of the thread ridge 44 at an inner peripheral surface of the cap 41 is moved down with sliding on the tapered part 14 of the mouth part 4 so as to be in contact to an upper surface of the first ridge of the screw-thread 5. At this time, by turning the cap 41 to the right, the lowest end of the thread ridge 44 is slid on the upper surface of the first ridge, and guided to an access to the below groove portion 34.

As described above, the tapered part 14 is formed to have the maximum outer diameter equal to or smaller than the minor thread diameter D2. Therefore, the thread ridge 44 on the inner peripheral surface of the cap 41 receives small resistance from the tapered part 14 and reaches to the upper surface of the first ridge. Then, the thread ridge 44 of the cap 41 can be guided to the access to the groove portion 34 below the first ridge. As a result, the cap 41 can be screwed by being rotated so that the lowest end of the thread ridge 44 advances into the groove portion 34.

Figure 9:
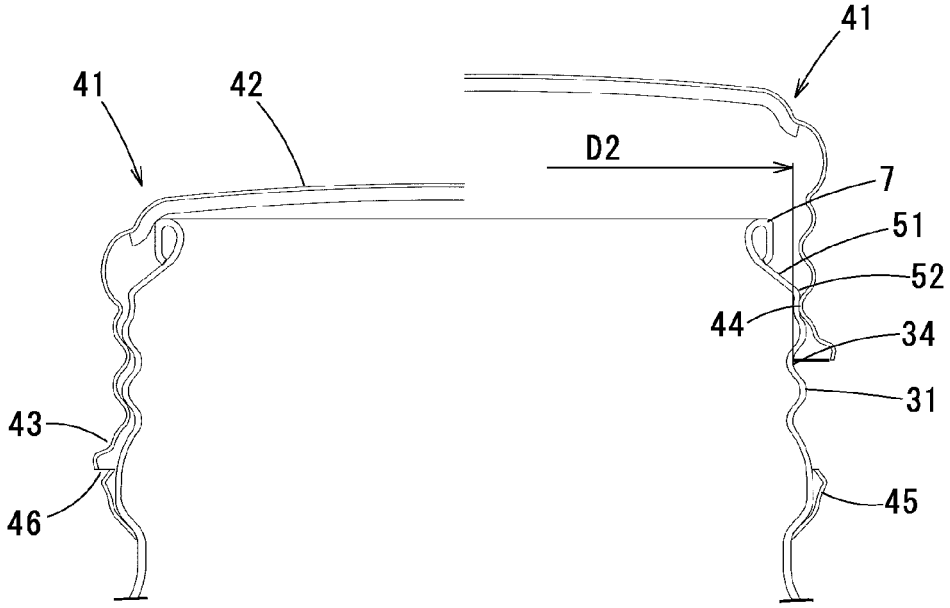
[FIG. 9] It is a sectional view showing a relationship between a cap and a conventional bottle-can, similar to FIG. 8.

A conventional bottle-can is explained with reference of FIG. 9. In the conventional bottle-can, a larger part 52 than the minor thread diameter is remained at a tapered part 51 above the first ridge. Therefore, when resealing the cap 41, contact degree between the larger part 52 than the minor thread diameter and the thread ridge 44 of the cap 41 is large, so that a resistance is large when the thread is screwed in, and the resealing operation is difficult.

Resealing torques when the bottle-can is resealed by the cap in a state in which the bottle-can is held on a digital torque meter made by NIDEC-SHIMPO Corporation were measured as resistance values generated when resealing the cap on the mouth part until a liner of a top plate of the cap is in contact with a top surface of a curl portion of the bottle-can. In the bottle-can of the embodiment according to the present invention, the resealing torque was 0.2 N·cm. In the conventional bottle-can, the resealing torque was 8.7 N·cm.

As described above, in the bottle-can 1 made by the producing method of the present invention, the tapered part 14 above the first ridge of the screw-thread 5 is formed as to be equal to the minor thread diameter D2 or smaller than the minor thread diameter D2, so that the resealing operation is easy.

The present invention is not limited to the above-described embodiments and various modifications may be made without departing from the scope of the present invention.

INDUSTRIAL APPLICABILITY

The screw-top bottle-can according to the present invention can be broadly applied as a bottle-can in which beverages such as coffee or the like is filled and the resealing by the cap is easy.

EXPLANATIONS OF REFERENCE SYMBOLS

1 bottle-can
2 shoulder part
3 neck part
4 mouth part

5 screw-thread
6 jaw part
7 curl portion
11 cylindrical part
12 intermediate formed product
13 opening-end part
14 tapered part
15 expanded-diameter portion
16 bend part
21 inner die
22 outer die
23, 24 protruded portion for thread-forming
25, 26 recess portion for thread-forming
31 ridge portion
32 incomplete-thread part
33 starting part of screw-thread
34 groove portion
41 cap
42 top-plate part
43 skirt part
44 thread-ridge
45 lower-end part
46 slit

What is claimed is:

1. A method for producing a screw-top bottle-can, comprising:

forming a shoulder part by reducing a diameter of an opening part of a closed-end cylindrical body;

forming a cylindrical part having an intermediate diameter between a major diameter and a minor diameter of a screw-thread and a tapered part which is tapered from an upper end of the cylindrical part toward the opening-end part above the shoulder part; and forming the screw-thread from the tapered part to the cylindrical part so as to form a starting part of the screw-thread at a middle of the tapered part, so that the tapered part is formed to have a maximum outer diameter which is equal to or smaller than the minor diameter of a groove portion which is adjacent to a first ridge of the screw-thread.

2. The method for producing a screw-top bottle-can according to claim 1, wherein in a vertical section along a can-axis direction at the starting part of the screw-thread, the screw-thread is formed so that a bend part between the tapered part and the cylindrical part is arranged in a region between a second ridge of the screw-thread and a groove portion above the second ridge.

3. The method for producing a screw-top bottle-can according to claim 1, wherein the tapered part is inclined at 10° to 30° with respect to a can-axis direction.

4. The method for producing a screw-top bottle-can according to claim 2, wherein the tapered part is inclined at 10° to 30° with respect to the can-axis direction.

5. A screw-top bottle-can which is produced by the method for producing according to claim 1.

6. A screw-top bottle-can according to claim 1, wherein the tapered part extends from the groove portion.

7. A screw-top bottle-can according to claim 1, wherein the tapered part and the groove portion together define a concave outer surface.

8. A screw-top bottle-can according to claim 7, wherein the maximum outer diameter of the tapered part is smaller than the minor diameter of the groove portion adjacent the first ridge of the screw-thread.

9. A screw-top bottle-can according to claim 1, wherein the maximum outer diameter of the tapered part is smaller than the minor diameter of the groove portion adjacent the first ridge of the screw-thread.

* * * * *